United States Patent [19]

Kinsella et al.

[11] 3,975,135

[45] Aug. 17, 1976

[54] BURNER CONTROL SYSTEM WITH CYCLING PILOT BURNER

[75] Inventors: Howard R. Kinsella; Carl F. Fernstrom, both of St. Louis, Mo.

[73] Assignee: Emerson Electric Co., St. Louis, Mo.

[22] Filed: Nov. 27, 1974

[21] Appl. No.: 527,793

[52] U.S. Cl. ..... 431/43; 431/58; 137/65

[51] Int. Cl.[2] ..... F23Q 9/12

[58] Field of Search ..... 431/43, 44, 46, 58, 431/51, 53, 54, 56; 137/65

[56] References Cited

UNITED STATES PATENTS 2,652,110 9/1953 Main ..... 431/46

3,721,263 3/1973 Visos et al. ..... 431/53

*Primary Examiner*—Carroll B. Dority, Jr.

*Attorney, Agent, or Firm*—Charles E. Markham

[57] ABSTRACT

A gas burner control system in which closure of a space thermostat causes energization of an electromagnetic actuator to supply fuel to a pilot burner and effect the operation of an igniter to ignite it; a thermostatic actuator heated by the pilot flame then effects the flow of fuel to a main burner where it is ignited by the pilot burner. The electromagnetic actuator also jointly controls the flow of fuel to the main burner, so that when the thermostat opens, de-energizing the electromagnetic actuator, fuel flow to the main burner as well as to the pilot burner is immediately cut off.

4 Claims, 1 Drawing Figure

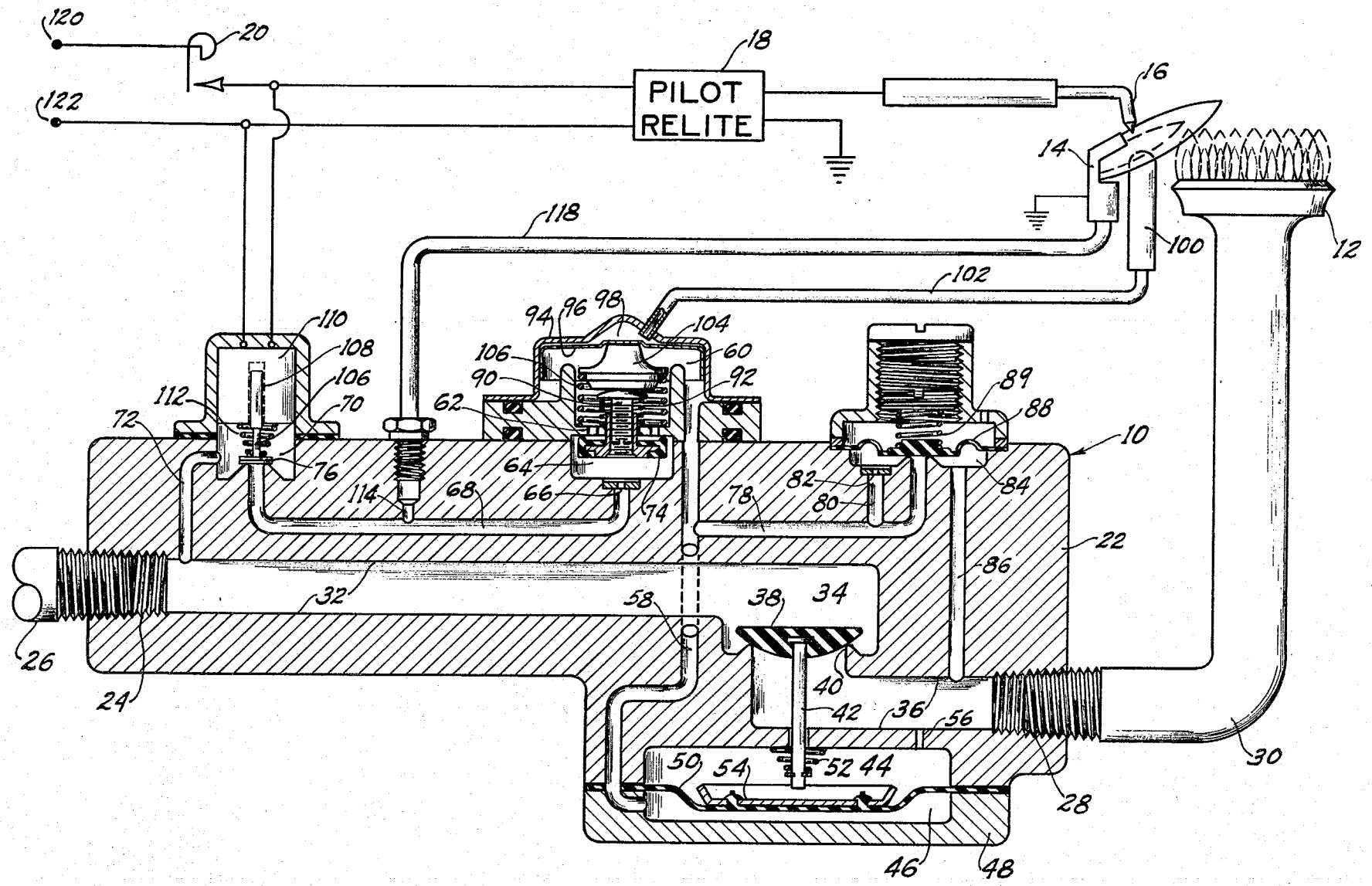
PILOT
RELITE

BURNER CONTROL SYSTEM WITH CYCLING PILOT BURNER

This invention relates to control systems for gas burners, and particularly to systems in which a pilot burner is cycled on and off with the closing and opening of a space thermostat and fuel flow to a main burner is controlled by means responsive to pilot burner flame.

Conventionally, gas burner control systems for space heating furnaces employ a continuously burning, "stand-by" pilot and a manually reset, thermoelectric safety valve including a thermocouple heated by the standing pilot burner. In these systems, whenever the pilot burner flame is extinguished for any reason, the safety valve closes. Upon relighting the pilot burner, it is necessary to manually reset the safety valve in open position and hold it open until the thermocouple is sufficiently heated by the pilot flame. When the main and pilot burners are located, for example, in a rooftop furnace, the incidence of pilot flame outage, due to wind gusts, occurs more frequently, and the chore of relighting the pilot burner and resetting the safety valve becomes considerably more arduous.

It is an object of this invention to provide a generally new and improved gas burner control system in which a pilot burner flame is established each time a space thermostat closes in demand for burner operation and in which fuel flow to a main burner can occur only when there is pilot flame.

A further object is to provide a gas burner control system wherein electromagnetically operated valve means and electrically operated ignition means are energized to establish a pilot burner flame upon closure of a space thermostat and a thermostatic actuator when heated by the pilot burner opens a valve causing fuel to flow to a main burner to be ignited by pilot flame; and wherein said electromagnetically operated valve is operative to override said thermostatically operated valve and effect the immediate cutoff of fuel to the main burner, as well as to the pilot burner, upon opening of the space thermostat.

Further objects and advantages will appear from the following description when read in connection with the accompanying drawing.

The single FIGURE of the drawing is a schematic illustration of a burner control system constructed in accordance with the present invention.

Referring to the drawing, the system includes as primary elements, a manifold gas valve generally indicated at 10, a main burner 12, a pilot burner 14, a spark igniter comprising an electrode 16 and a pulse generating means 18, and a space thermostat 20.

The manifold valve 10 comprises a body 22 having an inlet 24 adapted to receive a supply conduit 26 and an outlet 28 adapted to receive a fuel conduit 30 leading to main burner 12. A main fuel passageway means comprising a passage 32, a chamber 34, and a passage 36 connects the inlet 24 with outlet 28. A main valve 38 cooperating with a valve seat 40, formed in chamber 34, controls the flow from inlet 24 to outlet 28. The valve 38 has a stem 42 extending downward into a diaphragm chamber having an upper portion 44 formed as a recess in body 22 and a lower portion 46 formed by a cup-shaped member 48 attached to body 22. A flexible diaphragm 50 clamped at its periphery between body 22 and cup member 48 divides the chamber into the upper and lower portions 44 and 46.

The valve 38 is biased downward in a closed position on its seat 40 by a spring 52. The diaphragm 50 has a relatively rigid, centrally located member 54 adapted to engage the end of valve stem 42 and move the main valve 38 upward toward an open position when fluid pressure is applied to the lower side of diaphragm 50, causing it to flex upward.

The upper diaphragm chamber portion 44 is vented to the outlet passageway 36 through a vent 56. The lower diaphragm chamber portion 46 communicates with the inlet 24 through a passage 58, through an upper valve chamber 60, through apertures 62 in a wall separating upper valve chamber 60 from a lower valve chamber 64, through lower chamber 64, through an orifice 66 and a passage 68 to a valve chamber 70, thence through valve chamber 70, a passage 72, and the passage 32 to inlet 24.

There is an auxiliary, thermostatically-operated valve 74 seated on the wall dividing the upper and lower valve chambers 60 and 64 which is operative to control the flow through apertures 62 in this wall. There is also an auxiliary solenoid-operated valve 76 controlling the flow through valve chamber 70. Therefore, it will be seen that both valves 74 and 76 are required to be open in order to establish communication between the inlet 24 and lower valve chamber portion 46.

The pressure applied to the lower surface of diaphragm 50, when both auxiliary valves 74 and 76 are open, is always be less than the supply pressure at inlet 24 because of a constant and variable bleed-off extending through branched passageway means leading from passage 58 to outlet passage 36. This branched passageway means comprises passages 78 and 80, orifice 82, valve chamber 84, and passage 86 to passage 36 and outlet 28. Variable bleed-off is provided by a biased closed, diaphragm-type regulator valve 88 controlling the bleed-off rate through passage 78 in accordance with the pressure in outlet passage 36. A small, predetermined, constant bleed-off is also provided, for a purpose to be described, by the passage 80 and the orifice 82, which bypass the regulator valve 88.

The thermostatically operated auxiliary valve 74 has an upwardly extending stem 90, and the valve is biased closed by a spring 92. The upper valve chamber 60 is formed by a metal cup member 94 suitably connected to valve body 22. A thin, flexible, inner metal cup member 96 is nested in outer cup 94, and an expansible chamber 98 is formed between the bottom walls of cup members 94 and 96. The sidewall of inner cup member 96 is welded to the sidewall of outer cup member 94 to provide a pressure-tight expansible chamber 98. The expansible chamber 98 is connected to a bulb 100 by a capillary tube 102, and the bulb 100 contains a thermally expansible liquid, preferably mercury. There is a follower member 104 between the bottom wall of inner flexible cup member 96 and the upper end of valve stem 90, and a spring 106 biases follower member 104 upward and, therefore, biases the expansible chamber 98 in a contracted condition. When there is flame at the pilot burner 14, the mercury in bulb 100 vaporizes, causing expansible chamber 98 to expand and valve 74 to open.

The auxiliary solenoid-operated valve 76 has a stem 106 attached to a solenoid plunger 108 slidable vertically in an electromagnetic winding 110. A spring 112 biases valve 76 closed. When winding 110 is energized, valve 76 is opened. A branch passage 114 leads from passage 68 at a point between valves 74 and 76 to a pilot outlet 116, and a conduit 118 connected to outlet 116 supplies gas to pilot burner 14. The solenoid winding 110 is connected in parallel with the igniter pulse generating means 18 across power supply terminals 120 and 122 through the thermostat 20. When thermostat 20 closes, valve 76 is opened, permitting fuel to flow from inlet 24 to pilot burner 14, and the pulse generating means 18 is energized to effect its ignition.

The pulse generating means 18 may be of any suitable construction and arrangement which is operative to generate energy pulses of sufficient voltage to produce reliable igniting sparks across a gap between electrode 16 and a conductive metal pilot burner 14. We prefer, however, to employ the pulse generating means described in the application of Harry E. Newport, Jr., et al., for "Spark Ignition Circuit for Gas Burners," Ser. No. 470,712, filed May 17, 1974 and now U.S. Pat. No. 3,894,273. This ignition circuit is operable on a low voltage supply to provide reliable ignition and is operative to automatically cut off ignition when pilot flame is established.

OPERATION

When space thermostat 20 closes in response to a decrease in space temperature, solenoid winding 110 is energized, causing valve 76 to open and thereby permitting fuel to flow to pilot burner 14. Simultaneously, the pulse generating means 18 is energized and sparking occurs between electrode 16 and pilot burner 14 to ignite the pilot burner. Pilot burner flame now heats bulb 100, causing evaporation of the mercury therein, the expansion of expansible chamber 98, and the opening of valve 74.

When valve 74 opens, lower main diaphragm chamber portion 46 is placed in communication with supply pressure at inlet 24, which causes main diaphragm 50 to flex upward and open main valve 38, thereby permitting fuel to flow to main burner 12 where it is ignited by the pilot flame. The opening of main valve 38 causes a pressure increase in the outlet passage 36. This pressure increase in outlet passage 36 causes diaphragm regulator valve 88 to be opened an amount determined by the biasing force of an adjustable regulator spring 89. The opening of regulator valve 88 permits bleed off, which reduces the pressure applied to the underside of main valve operating diaphragm 50, so that the amount of opening of main fuel valve 38, and, therefore, the rate of flow to the main burner 12, is dependent upon adjustment of the pressure regulator biasing spring 89.

When space thermostat 20 opens in response to an increase in space temperature resulting from main burner operation, the solenoid operated auxiliary valve 76 closes, immediately cutting off communication between inlet 24 and lower diaphragm chamber 46. The pressure existing in chamber 46 at this time now bleeds off to outlet passage 36 through the constant bleed orifice 82, thereby permitting diaphragm 50 to flex downward and valve 38 to be closed by spring 52.

The closure of valve 76 also cuts off fuel to pilot burner 14, causing the pilot flame to be exinguished. When the pilot flame is extinguished, the mercury in bulb 100 condenses, thereby permitting contraction of expansible chamber 98 by spring 106 and closure of valve 74 by spring 92. Opening of the space thermostat 20 also de-energizes the spark ignition, pulse generating means 18.

If the pilot burner flame is extinguished during a closed thermostat, burner-operating condition, the ignition means will immediately re-ignite the pilot burner. If the pilot burner is extinguished and fails to re-ignite for any reason during burner operation, the bulb 100 will cool and auxiliary valve 74 will close, thereby cutting off communication between the inlet 24 and lower diaphragm chamber 46 whereby valve 38 will close.

It will be seen from the foregoing that the opening of thermostatically-operated auxiliary valve 74, and therefore the opening of main fuel valve 38, is dependent upon the existence of a flame at the pilot burner 14. It will also be seen that by arranging the solenoid-operated auxiliary valve 76 in series with the thermostatically-operated auxiliary valve 74 the cutoff of operating pressure to lower diaphragm chamber 46, and therefore the closure of main fuel valve 38, will occur immediately upon opening of the space thermostat.

The constant bleed-off orifice 82 is sufficiently smaller than the orifice 66 to provide a net operating pressure adequate to operate main valve 38, yet is of sufficient size to permit exhausting diaphragm chamber 46 and closure of valve 38 in a short time following closure of valve 76. When either of valves 74 or 76 is closed, the pressure on both sides of diaphragm 50 becomes equal.

We claim:

1. In a gas burner control system,
- a space thermostat,
- an electrical power source,
- a source of fuel gas under pressure,
- a main burner,
- a pilot burner,
- a biased closed main valve controlling the flow of gas to said main burner,
- an expansible chamber operatively associated with said main valve and operative to open said valve, when gas pressure is applied thereto,
- a first biased closed auxiliary valve controlling the flow of gas to said pilot burner and to said expansible chamber,
- solenoid means operative when energized to open said first auxiliary valve,
- electrically operated ignition means operative when energized to ignite said pilot burner,
- a second biased closed auxiliary valve controlling the flow of gas to said expansible chamber, said second auxiliary valve being in series flow relationship with said first auxiliary valve with respect to said fuel gas source and said expansible chamber.
- thermostatic means arranged to be heated by pilot burner flame and operative when so heated to open said second auxiliary valve,
- means to exhaust said expansible chamber when either said first or said second auxiliary valve closes, and
- circuit means under control of said space thermostat connecting said solenoid means and said ignition means across said power source.

2. The gas burner control system claimed in claim 1 wherein said thermostatic means comprises an expansible chamber operatively connected to said second auxiliary valve, a bulb positioned adjacent said pilot burner, a capillary tube connecting said bulb and expansible chamber, and a thermally expansible fluid in said bulb.

3. The gas control system claimed in claim 1 in which said means to exhaust said expansible chamber when either of said auxiliary valves is closed comprises a constant limited venting means for said expansible chamber.

4. In a gas burner control system, a space thermostat, an electrical power source, a source of gas under pressure, a main burner, a pilot burner, a biased closed main valve controlling the flow of gas to said main burner, an expansible chamber operatively associated with said main valve and operative to open said valve when gas pressure is applied thereto, a first biased closed auxiliary valve controlling the flow of gas to said pilot burner, electromagnetic means operative when energized to open said first auxiliary valve, electrically operated ignition means operative when energized to ignite said pilot burner, a second biased closed auxiliary valve controlling the flow of gas to said expansible chamber, thermostatic actuating means arranged to be heated by pilot flame and operative when so heated to open said second auxiliary valve, limited venting means for exhausting said expansible chamber to permit closure of said main valve when said second auxiliary valve closes, and circuit means under control of said space thermostat connecting said electromagnetic means and said ignition means across said power source.

* * * * *